US011326747B2

(12) United States Patent
Weaver et al.

(10) Patent No.: US 11,326,747 B2
(45) Date of Patent: May 10, 2022

(54) OPTICAL AND MECHANICAL MANIPULATION OF LIGHT EMITTING DIODE (LED) LIGHTING SYSTEMS

(71) Applicant: LUMENETIX, LLC, Scotts Valley, CA (US)

(72) Inventors: Matthew D. Weaver, Scotts Valley, CA (US); Yuko Nakazawa, Santa Cruz, CA (US)

(73) Assignee: LUMENETIX, LLC, Scotts Valley, CA (US)

( * ) Notice: Subject to any disclaimer, the term of this patent is extended or adjusted under 35 U.S.C. 154(b) by 120 days.

(21) Appl. No.: 16/595,380

(22) Filed: Oct. 7, 2019

(65) Prior Publication Data

US 2020/0037413 A1 Jan. 30, 2020

Related U.S. Application Data

(62) Division of application No. 15/382,578, filed on Dec. 16, 2016, now Pat. No. 10,440,796.

(60) Provisional application No. 62/269,054, filed on Dec. 17, 2015.

(51) Int. Cl.

| | |
|---|---|
| ***F21K 9/62*** | (2016.01) |
| ***F21V 3/02*** | (2006.01) |
| ***H05B 45/24*** | (2020.01) |
| *F21Y 103/10* | (2016.01) |
| *F21Y 113/13* | (2016.01) |
| *F21Y 115/10* | (2016.01) |

(52) U.S. Cl.

CPC ..... *F21K 9/62* (2016.08); *F21V 3/02* (2013.01); *H05B 45/24* (2020.01); *F21Y 2103/10* (2016.08); *F21Y 2113/13* (2016.08); *F21Y 2115/10* (2016.08)

(58) Field of Classification Search

CPC ..... F21K 9/62; F21Y 2103/10; H05B 45/24

See application file for complete search history.

(56) References Cited

U.S. PATENT DOCUMENTS

| | | | | |
|---|---|---|---|---|
| 9,288,865 | B2 | 3/2016 | Bowers | |
| 2006/0262544 | A1 | 11/2006 | Mok et al. | |
| 2011/0109445 | A1* | 5/2011 | Weaver | H05B 45/22 340/286.01 |
| 2012/0026728 | A1* | 2/2012 | Lou | F21V 7/005 362/217.05 |

(Continued)

*Primary Examiner* — Alexander H Taningco
*Assistant Examiner* — Pedro C Fernandez
(74) *Attorney, Agent, or Firm* — Lewis Roca Rothgerber Christie LLP

(57) ABSTRACT

Various examples concern techniques for opto-mechanically manipulating LED-based lighting systems. More specifically, various embodiments concern creating patterns of colored LEDs by determining the preferred color-specific density distribution and sequence(s) of LEDs. When creating the patterns, multiple considerations can be taken into account, including the power to be shared amongst the color channels when certain color models are generated by the linear array of LEDs, allocating an appropriate number of LEDs to each color channel to support the desired color spectrum, the sequencing of those LEDs along a string (e.g., as part of a linear array), etc. The appropriate number of LEDs for each color channel may be determined by first establishing the color model of the linear array within which the LEDs are interleaved.

11 Claims, 12 Drawing Sheets

(56) References Cited

U.S. PATENT DOCUMENTS

| | | | | |
|---|---|---|---|---|
| 2014/0168777 | A1* | 6/2014 | Cochran | G02B 6/0096 359/599 |
| 2015/0109774 | A1* | 4/2015 | Deregibus | F21K 9/62 362/231 |
| 2015/0159818 | A1 | 6/2015 | Dong et al. | |
| 2015/0230409 | A1* | 8/2015 | Nicole | A01G 9/14 315/153 |
| 2017/0162547 | A1* | 6/2017 | Bergmann | H01L 33/502 |

* cited by examiner

OPTICAL AND MECHANICAL MANIPULATION OF LIGHT EMITTING DIODE (LED) LIGHTING SYSTEMS

CROSS-REFERENCE TO RELATED APPLICATIONS

This application is a divisional of U.S. patent application Ser. No. 15/382,578, filed Dec. 16, 2016, which claims the benefit of and priority to U.S. Provisional Application No. 62/269,054, entitled, "OPTICAL AND MECHANICAL MANIPULATION OF LIGHT EMITTING DIODE (LED) LIGHTING SYSTEMS", filed Dec. 17, 2015, the disclosures of each of which are incorporated herein by reference.

FIELD OF THE INVENTION

Various embodiments concern techniques for opto-mechanically manipulating LED-based lighting systems.

BACKGROUND

Traditional lighting systems typically relied on conventional lighting technologies, such as incandescent bulbs and fluorescent bulbs. But these light sources suffer from several drawbacks. For example, such light sources do not offer long life or high energy efficiency. Moreover, such light sources offer only a limited selection of colors, and the color of light output by these light sources generally changes over time as the bulbs age and begin to degrade. Consequently, light emitting diodes (LEDs) have become an attractive option for many applications. The vast majority of LED-based lighting systems, however, use fixed white LEDs with no tunable range.

Although LED-based systems are capable of having longer lives and offering high energy efficiency, issues still exist (e.g., degradation of color over time, responsiveness of color tuning adjustments). These issues can be compounded when multiple LED-based lighting systems are placed near one another or are coupled directly to one another.

Moreover, printed circuit board assemblies (PCBAs) with LEDs often exhibit undesirable acoustic effects when the PCBAs are driven at particular (e.g., resonant) frequencies in the human hearing range (e.g., approximately 50 Hz to 25 kHz). For instance, sound may be produced by vibrating capacitors, such as piezoelectric ceramic capacitors that change dimensions in response to an applied voltage. Some inductors may also create noise by magnetostriction. Although solutions (e.g., specialty dampeners, low drive acoustic capacitors) have been proposed in an effort to reduce or eliminate these acoustic effects, this problem continues to plague PCBAs regardless of application (i.e., not just when used as part of a lighting system).

A light source can be characterized by its color temperature and by its color rendering index (CRI). The color temperature of a light source is the temperature at which the color of light emitted from a heated black-body radiator is matched by the color of the light source. For a light source that does not substantially emulate a black body radiator, such as a fluorescent bulb or LED, the correlated color temperature (CCT) of the light source is the temperature at which the color of light emitted from a heated black-body radiator is approximated by the color of the light source.

The CCT can also be used to represent chromaticity of white light sources. But because chromaticity is two-dimensional, Duv (as defined in ANSI C78.377) can be used to provide another dimension. When used with a MacAdam ellipse, which represents the colors distinguishable to the human eye, the CCT and Duv allow the visible color output by an LED-based lighting system to be more precisely controlled (e.g., by being tuned).

The CRI, meanwhile, is a rating system that measures the accuracy of how well a light source reproduces the color of an illuminated object (in comparison to an ideal or natural light source). The CRI is determined based on an average of eight different colors (R1-R8). A ninth color (R9) is a fully saturated test color that is not used in calculating CRI, but can be used to more accurately mix and reproduce the other colors. The CCT and CRI of LEDs is typically difficult to tune and adjust. Further difficulty arises when trying to maintain an acceptable CRI while varying the CCT of an LED.

BRIEF DESCRIPTION OF THE DRAWINGS

These and other objects, features, and characteristics will become more apparent to those skilled in the art from a study of the following Detailed Description in conjunction with the appended claims and drawings, all of which form a part of this specification. While the accompanying drawings include illustrations of various embodiments, the drawings are not intended to limit the claimed subject matter.

Figure 1:
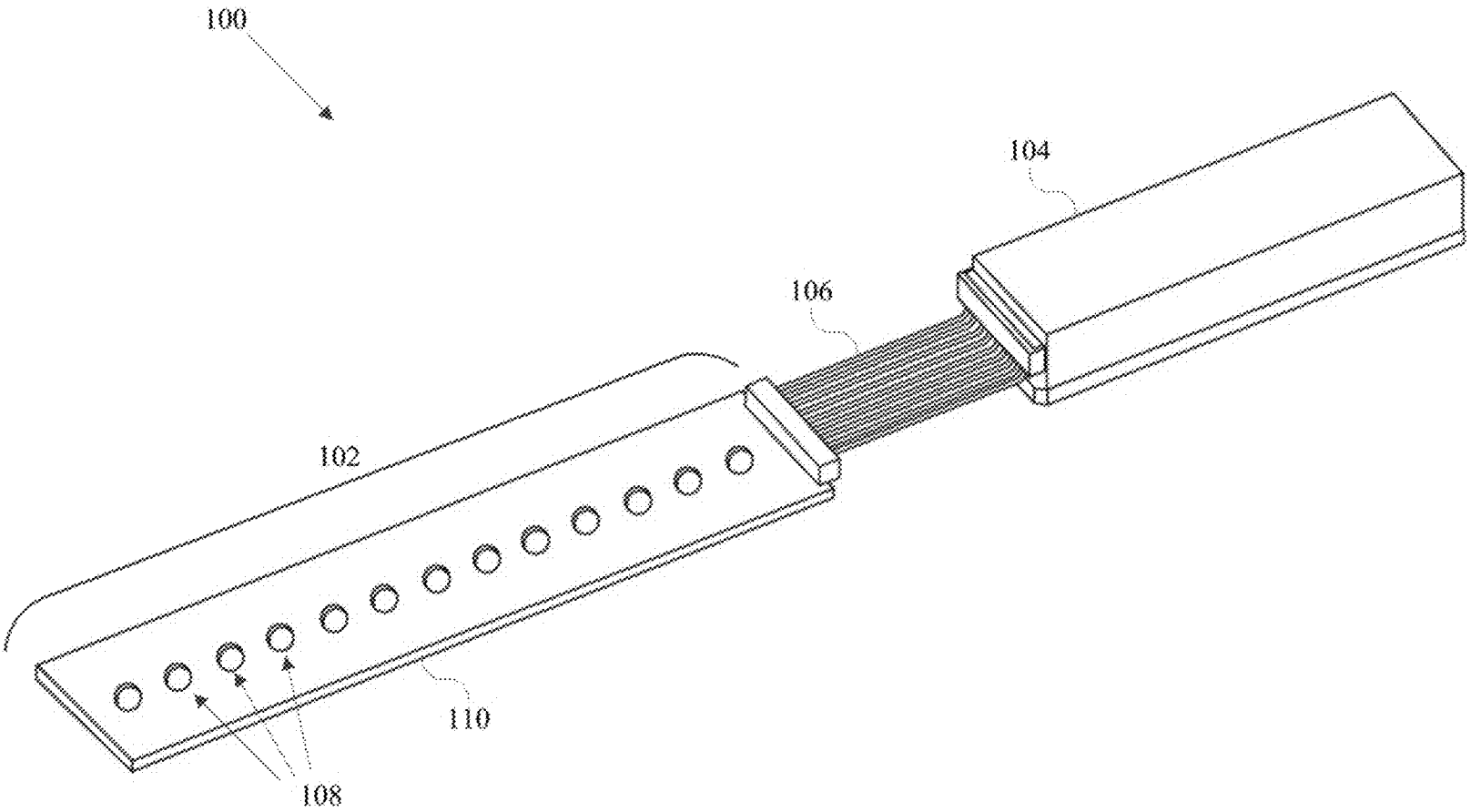
FIG. 1 depicts an example of an LED-based lighting system that includes an LED board coupled to a tuning controller by a ribbon cable as may occur in various embodiments.

The figures depict various embodiments described throughout the Detailed Description for purposes of illustration only. While specific embodiments have been shown by way of example in the drawings and are described in detail below, the embodiments are amenable to various modifications and alternative forms. The intention is not to limit the disclosure to the particular embodiments described. Accordingly, the claimed subject matter is intended to cover all modifications, equivalents, and alternatives falling within the scope of the invention as defined by the appended claims.

DETAILED DESCRIPTION

Various example concern techniques for opto-mechanically manipulating LED-based lighting systems. More specifically, various embodiments concern creating patterns of colored LEDs by determining the preferred color-specific density distribution and sequence(s) of LEDs. When creating the patterns, multiple considerations can be taken into account, including the power to be shared amongst the color channels when certain color models are generated by the linear array of LEDs, allocating an appropriate number of LEDs to each color channel to support the desired color spectrum, the sequencing of those LEDs along a string (e.g., as part of a linear array), etc. The appropriate number of LEDs for each color channel may be determined by first establishing the color model of the linear array within which the LEDs are interleaved.

Techniques are also described herein for determining color characteristics of a lighting system using photodiodes that are configured to detect a predetermined sequence of illuminations by the linear array of LEDs.

Various embodiments also concern opto-mechanically attenuating and redirecting the light generated by the outermost LEDs of a linear array back toward the linear array (i.e., in the axial direction) using an optical hood installed at the outermost ends of the linear array. Rather than employ a software-based or firmware-based windowed approach that may be difficult to consistently implement with accuracy, the optical hoods rely on the natural mixing of the light (e.g., within a lighting troffer) to reduce or substantially eliminate any discontinuities.

The technologies introduced herein can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to program a computer (or another electronic device) to perform a process. The machine-readable medium may include, but is not limited to, floppy diskettes, optical disks, compact disk read-only memories (CD-ROMs), magneto-optical disks, read-only memories (ROMs), random access memories (RAMs), erasable programmable read-only memories (EPROMs), electrically erasable programmable read-only memories (EEPROMs), magnetic or optical cards, flash memory, or any other type of media/machine-readable medium suitable for storing electronic instructions.

Terminology

Brief definitions of terms, abbreviations, and phrases used throughout this application are given below.

Reference in this specification to "one embodiment" or "an embodiment" means that a particular feature, structure, or characteristic described in connection with the embodiment is included in at least one embodiment of the disclosure. The appearances of the phrase "in one embodiment" or "in some embodiments" in various places in the specification are not necessarily all referring to the same embodiment(s), nor are separate or alternative embodiments mutually exclusive of other embodiments. Moreover, various features are described which may be exhibited by some embodiments and not by others. Similarly, various requirements are described which may be requirements for some embodiments but not other embodiments.

Unless the context clearly requires otherwise, throughout the Detailed Description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. For example, two devices may be coupled directly, or via one or more intermediary channels or devices. As another example, devices may be coupled in such a way that information can be passed there between, while not sharing any physical connection with one another. Additionally, the words "herein," "above," "below," and words of similar import, when used in this application, shall refer to this application as a whole and not to any particular portions of this application. Where the context permits, words in the Detailed Description using the singular or plural number may also include the plural or singular number respectively. The word "or," in reference to a list of two or more items, covers all of the following interpretations of the word: any of the items in the list, all of the items in the list, and any combination of the items in the list.

If the specification states a component or feature "may," "can," "could," or "might" be included or have a characteristic, that particular component or feature is not required to be included or have the characteristic.

The term "module" refers broadly to software, hardware, or firmware (or any combination thereof) components. Modules are typically functional components that can generate useful data or other output using specified input(s). A module may or may not be self-contained.

The terminology used in the Detailed Description is intended to be interpreted in its broadest reasonable manner, even though it is being used in conjunction with certain examples. The terms used in this specification generally have their ordinary meanings in the art, within the context of the disclosure, and in the specific context where each term is used. For convenience, certain terms may be highlighted, for example using capitalization, italics, and/or quotation marks. The use of highlighting has no influence on the scope and meaning of a term; the scope and meaning of a term is the same, in the same context, whether or not it is highlighted. It will be appreciated that same element can be described in more than one way.

Consequently, alternative language and synonyms may be used for any one or more of the terms discussed herein. However, special significance is not to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and is not intended to further limit the scope and meaning of the disclosure or of any exemplified term. Likewise, the disclosure is not limited to various embodiments given in this specification.

Color-Specific Density Distribution of LEDs

FIG. 1 depicts an example of an LED-based color tunable lighting system 100 that includes an LED-based light source (hereinafter referred to as an LED board 102), such as a PCBA that includes LEDs of different colors, coupled to a logic module 104 (which is referred to as a color logic module) by a ribbon cable 106. By separating one or more processing components (e.g., processors, drivers, power couplings) from the LED board 102, the techniques described herein enable the necessary driver(s), processor(s), etc., to be housed within the logic module 104 rather than on the LED board 102. Consequently, the LED board 102 can be intelligently controlled by the logic module 104, despite the LED board 102 not retaining the necessary components itself.

The LED board 102 can also include one or more photodiodes (not pictured) that are able to feedback the light spectra to the logic module 104 of, for example, the lighting troffer within which the LED board 102 is installed. Because the photodiodes depend on measuring backscattered light produced by the color LEDs 108 on the LED board 102, changes to the fixture (e.g., the LED board 102 is placed within a larger or smaller troffer) will affect the light spectra measures by the photodiode(s). The logic module 104, therefore, may be configured to illuminate the color LEDs 108 in a particular sequence when the LED board 102 is installed within the fixture, and the photodiode(s) can detect the backscattered components of the particular sequence. Because the illuminated sequence has been predetermined, the logic module 104 is able to establish color characteristics (e.g., K factor) of the lighting system 100.

Although the LED board 102 is illustrated by FIG. 1 as an array of color LEDs 108 positioned linearly on a substrate, other patterns are also possible and, in some cases, may be preferable. For example, the LED board 102 may include a circular pattern or cluster of mid-power LEDs, a single high power LED, or some other lighting feature.

Linear arrays of color LEDs 108 often experience significant problems with mixing and LED utilization (i.e., fully utilizing the LEDs installed on the PCBA). For example, one common issue is that some color channels require more LEDs than others. Moreover, the LEDs of each color channel occur at different frequencies and it can be difficult to interleave the different frequencies amongst one another so that the LEDs continue to mix appropriately. Consequently, it is desirable to identify color-specific density distributions that optimize the number of LEDs of each color and arrange those LEDs so that they are able to achieve a desired color spectrum.

Figure 2:
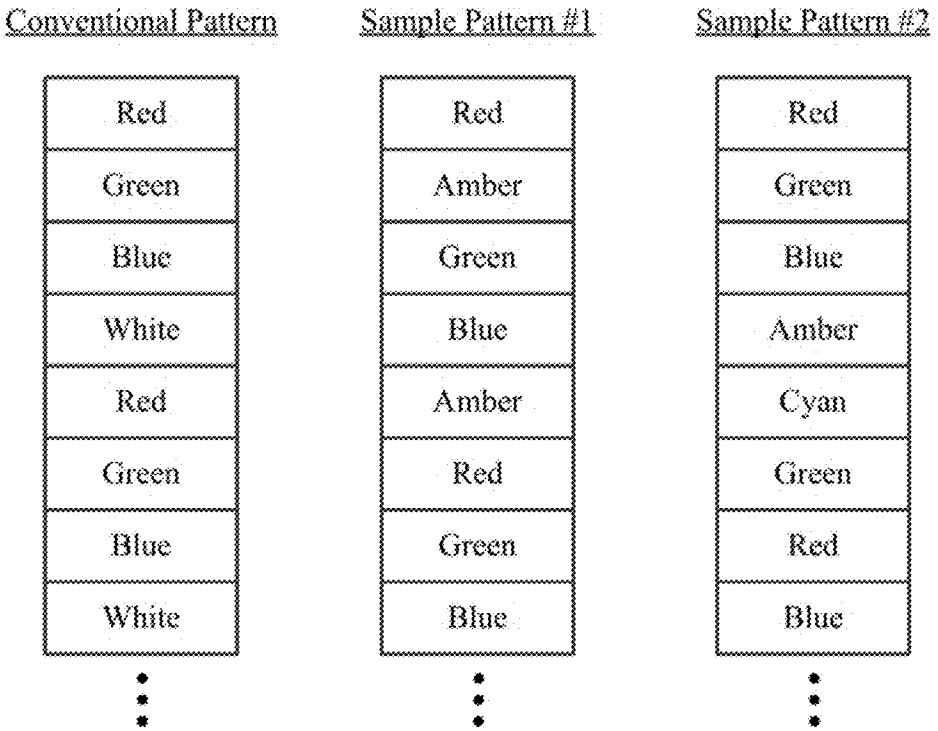
FIG. 2 depicts various example patterns of colored LEDs.

FIG. 2 depicts various example patterns of colored LEDs. When creating the patterns, multiple considerations can be taken into account, including the power to be shared amongst the color channels when certain color models are generated by the linear array of LEDs, allocating an appropriate number of LEDs to each color channel to support the desired color spectrum, the sequencing of those LEDs along a string (e.g., as part of a linear array), etc. As further described below, the appropriate number of LEDs can be determined by establishing the color model of the linear array (e.g., by using an algorithm), as described in co-pending U.S. application Ser. No. 13/766,707, which is incorporated herein by reference in its entirety. Another algorithm can then determine an appropriate pattern for the LEDs and phasing of the pattern(s).

Conventionally, linear arrays of colored LEDs include groups or clusters of colored LEDs that repeat with a certain frequency. For example, the colored LEDs in a linear array may be arranged such that they repeat patterns of red-green-blue, red-green-cyan-amber (e.g., phosphor-converted amber), or red-green-blue-white. But such a pattern causes certain colors (e.g., blue or cyan) to be included far more frequently than is necessary or desired. Moreover, these repeated groups of colored LEDs limit the density of the linear array, which affects total brightness and output (in lumens).

Thus, it is desirable to determine how many LEDs of each color (regardless of the number of color channels) are necessary to create a desired color spectrum, and how to arrange those LEDs within a linear array. The techniques introduced here arrange the LEDs for a particular color channel at varying densities (i.e., not as part of a continuously repeating cluster of LEDs). Said another way, each unique set of colored LEDs need not be repeated continuously. Such a pattern allows each color channel to be fully utilized (i.e., be provided full power) when the brightness of the linear array is set to a maximum value.

For example, the quantity and arrangement of color LEDs within a cluster may depend on the desired maximum/minimum intensity, desired color spectrum range, the number of color channels, etc. In some embodiments, two LEDs of the same color may be positioned next to one another (i.e., the interval is a single LED), while in other embodiments only one LED of a particular color may be present in the entire cluster. The maximum period or interval distance between LEDs of the same color may also relate to the distance between the LEDs (i.e., the PCBA) and the diffuser cover. As another example, the minimum period may be determined using established color model(s), as described in co-pending U.S. application Ser. No. 13/766,707.

In some embodiments, a "discrete location" algorithm is used to determine an appropriate pattern for a certain allocation of color LEDs. First, the density for each color channel is determined (e.g., using the established color model(s) as described above). Second, linear patterns of the calculated density can be overlapped. The linear patterns can then be shifted to find the maximum room to fix (e.g., within a cluster or on a PCBA). When a color LED does not fit after being shifted, it can be moved to the nearest available location on the PCBA.

Note that the techniques described herein are applicable regardless of the number of color channels. For example, a linear array having three color channels (e.g., red, green, and blue) and a linear array having four color channels (e.g., red, green, blue, amber, cyan) could both be modified according to the color-specific density techniques describer here. As color channels are added or removed from the linear array, the sequencing (i.e., spacing) of unique sets of colored LEDs may also change. For example, the addition of a cyan LEDs may reduce the need for royal blue LEDs.

A linear pattern of colored LEDs may also depend on the intended application and desired CCT of the linear array. For example, a linear array configured for a low CCT setting, such as a restaurant, may have a different pattern than an LED board configured for a high CCT setting, such as a hospital. The patterns could have different proportions of LEDs allocated to each color, different sequences of colored LEDs, or both.

Although linear arrays are used herein for purposes of illustration, the techniques are also applicable to other arrangements of LEDs (e.g., parallel arrays, matrices, or clusters of LEDs). The LEDs dispersed along a PCBA also need not be equidistant from one another, and, in fact, it may be desirable to have certain groups (i.e., sets of particular color LEDs) positioned closer to one another to allow for better mixing. Although these techniques for determining color-specific density distributions are generally most efficient with narrow linear LED arrays, where the beams are easily shapeable and dispersion is governed by one-dimensional optics, they can also be adopted for the various other arrangements described above. However, modifications to the algorithms are necessary in such a scenario.

Two general techniques exist for determining an appropriate pattern of colored LEDs. First, all possible sequences can be identified based on the color-specific density distribution, and then a user or a computing system can identify the preferred pattern based on the desired color spectrum, color usage, etc. Because the number of possible sequences is typically large, a special-purpose computing system generally identifies the preferred sequence based on constraints input by the user. Second, an algorithm can be employed to identify the preferred pattern based on a series of constraints (e.g., desired color spectrum, power usage).

The algorithm could also be used to generate patterns that satisfy mixing requirements in additional dimensions (e.g., parallel linear arrays, matrices, or clusters of LEDs). One or more preferred patterns can be identified based on various factors, such as minimizing the number of unnecessary and underutilized LEDs and improving efficacy.

Both techniques result in a unique (i.e., non-repeating) linear array of a certain length (e.g., a 6-inch long "cluster" of LEDs), which may be repeated over a larger space. For example, a 24-inch long linear array may be composed of four 6-inch long clusters laid end-to-end. Because the manner in which the smaller segments (i.e., the clusters) have been designed, they can be laid end-to-end without creating any additional mixing issues.

Figure 3:
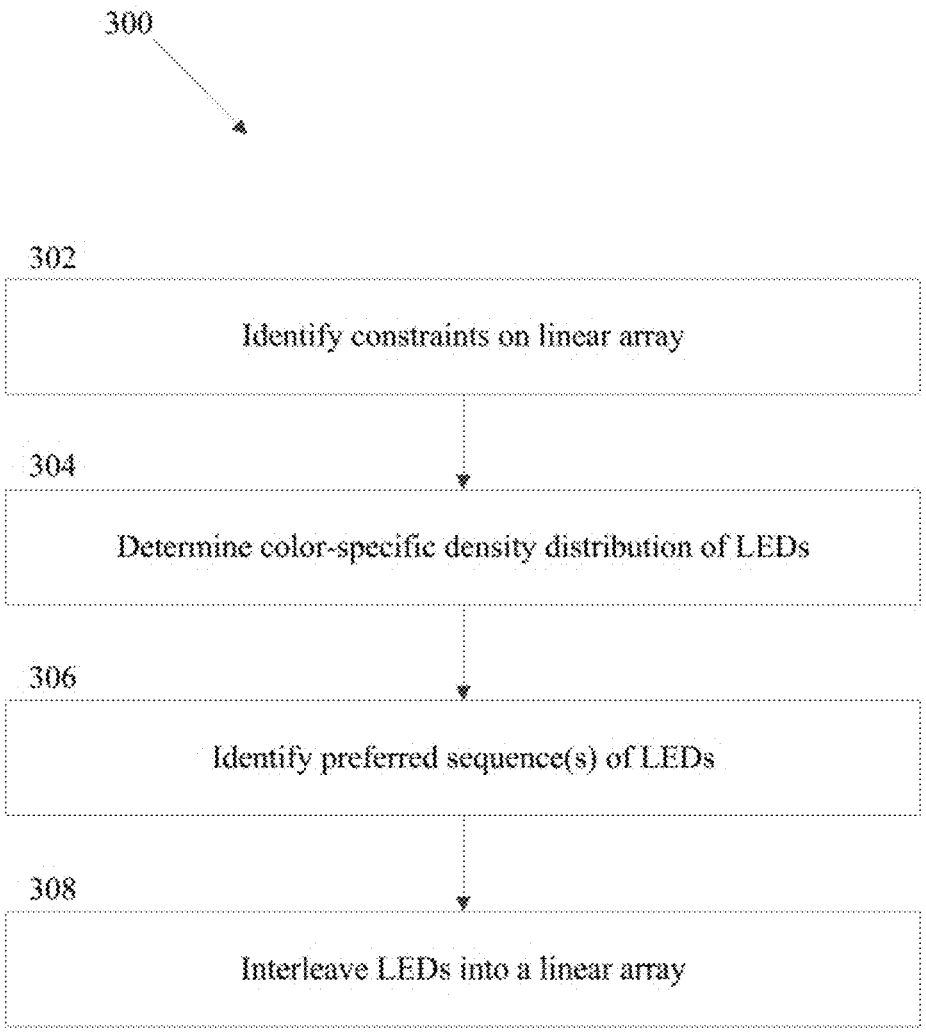
FIG. 3 depicts a process for determining the appropriate color-specific density distribution and sequence of LEDs given a series of constraints.

FIG. 3 depicts a process 300 for determining the appropriate color-specific density distribution and sequence of LEDs given a series of constraints. First, the constraints on the linear array of LEDs is identified (step 302). The constraints can include, for example, the desired color spectrum, the desired brightness level, the total power necessary and/or available to the linear array of LEDs, etc. Then an appropriate color-specific density distribution is determined using, for example, an algorithm that establishes the color model for the linear array of LEDs (step 304). That is, the number of LEDs needed for each color channel is calculated based on the constraints. One or more sequences of colored LEDs can then be identified based on the density distribution of the LEDs among the different color channels (step 306). After a preferred sequence has been selected (e.g., by a user or via an algorithm), the LEDs are interleaved in the linear array (step 308).

Techniques for Optimizing Color Mixing

As illustrated in FIG. 1, LED-based light sources often include a linear array or "string" of color LEDs. However, mixing is naturally unbalanced at both ends of the linear array because the outermost LEDs only have one neighboring LED. Thus, the outermost LEDs are only able to mix with one other LED, which typically causes a discontinuity (e.g., a color shift) in the light emanating from the ends of the linear array. For instance, as shown in FIG. 4E, the light output by the outermost LED of an untreated PCBA (i.e., a PCBA without an optical terminator) will have an unbalanced output, which here appears to be red. Although this problem can be somewhat mitigated in large lighting systems by placing multiple linear arrays of color LEDS next to one another (e.g., end to end), the issue still exists for the outermost LEDs of the linear array(s).

One technique for mitigating the color shift is attenuating the intensity of those LEDs closest to the outer ends. This may be referred to as a "windowed approach." This approach, however, can cause several different solutions to be generated that depend on the CCT, operating conditions, etc. Consequently, a software-based or firmware-based windowed approach is generally difficult to readily implement.

Alternatively, the light generated by the outermost LEDs can be opto-mechanically attenuated and redirected back toward the linear array (i.e., in the axial direction) by installing an optical terminator at each end of the linear array. The optical terminators rely on the natural mixing of the light (e.g., within a lighting troffer) to reduce or substantially eliminate any discontinuities, rather than the software-based or firmware-based windowed approach that may be difficult to consistently implement with accuracy.

Figure 4A:
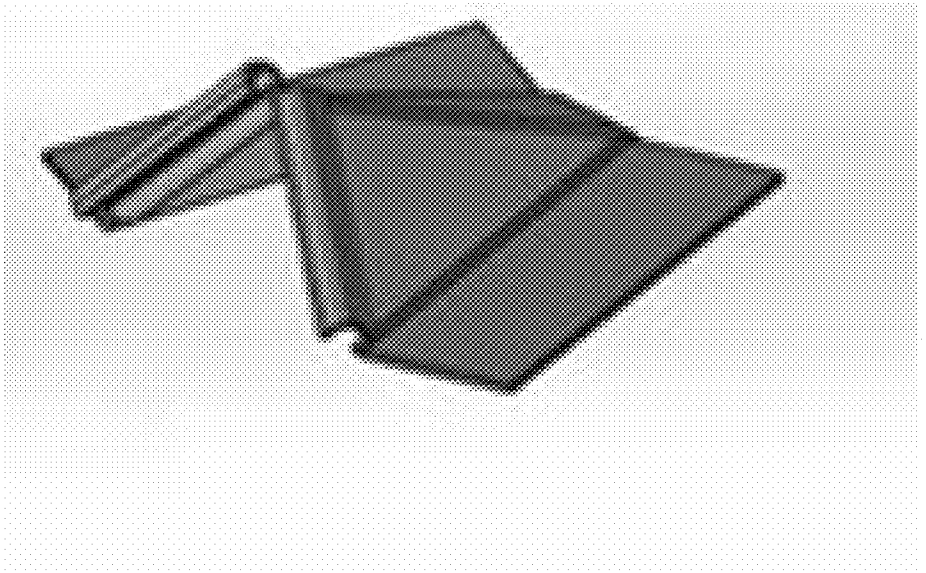
FIGS. 4A-E depicts various embodiments of optical hoods having different shapes and sizes.
Figure 4B:
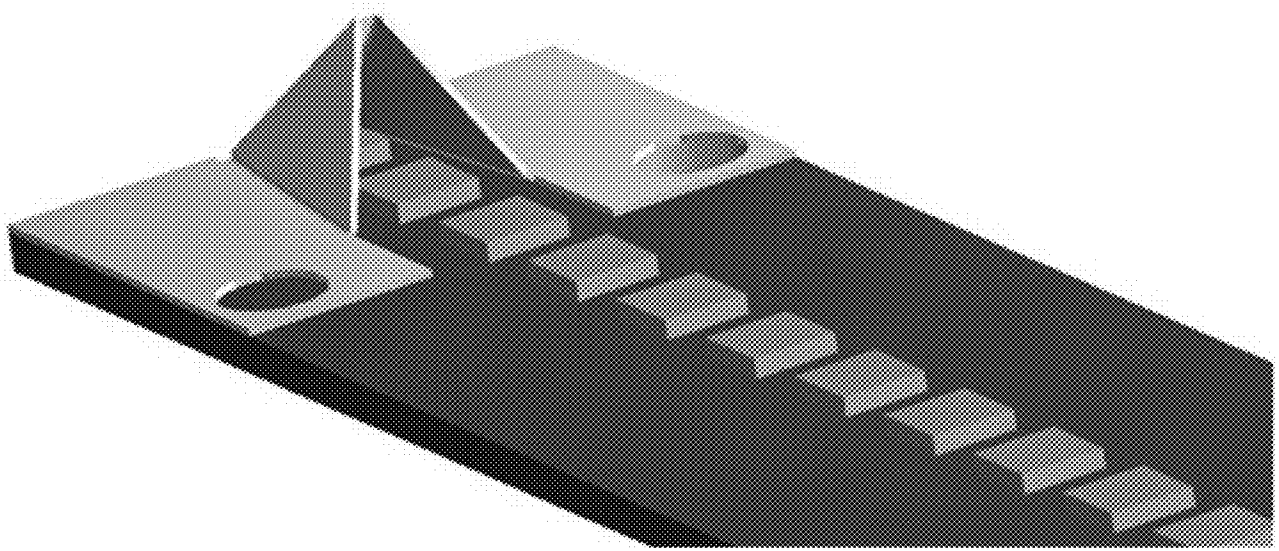
Figure 4C:
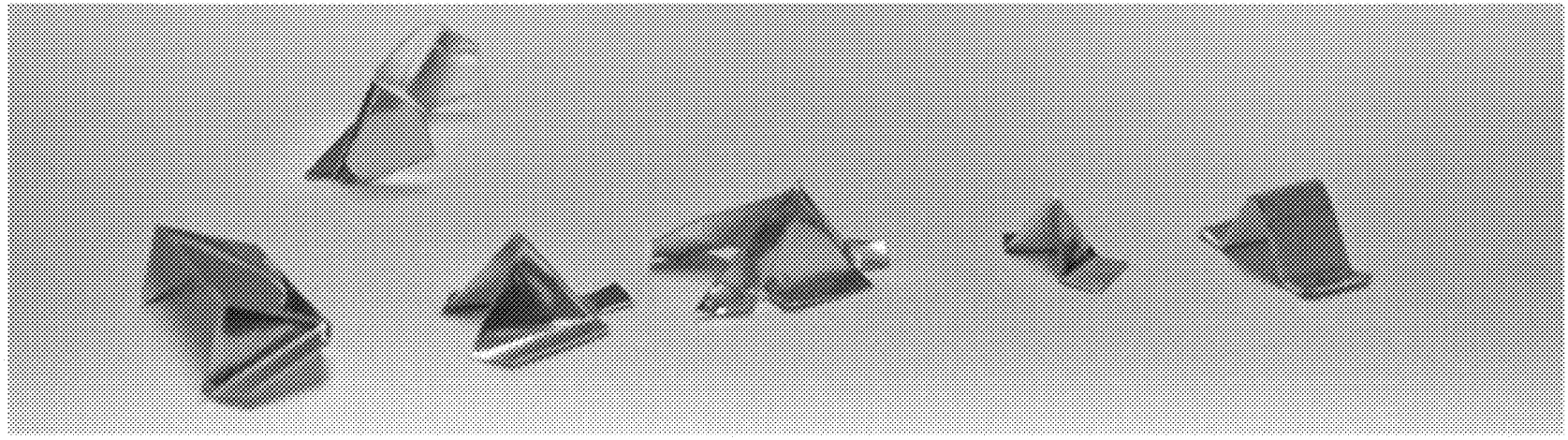

As shown in FIGS. 4A-C, the optical terminators can be embodied in various shapes and sizes. The shape and size of an optical terminator can be based on the shape and size of the linear array of LEDS and/or the lighting troffer. The optical terminators could be composed of any material that is a strong reflector of visible light (e.g., silver, aluminum, copper). The inside of the optical terminators may be specular or diffuse.

Figure 4D:
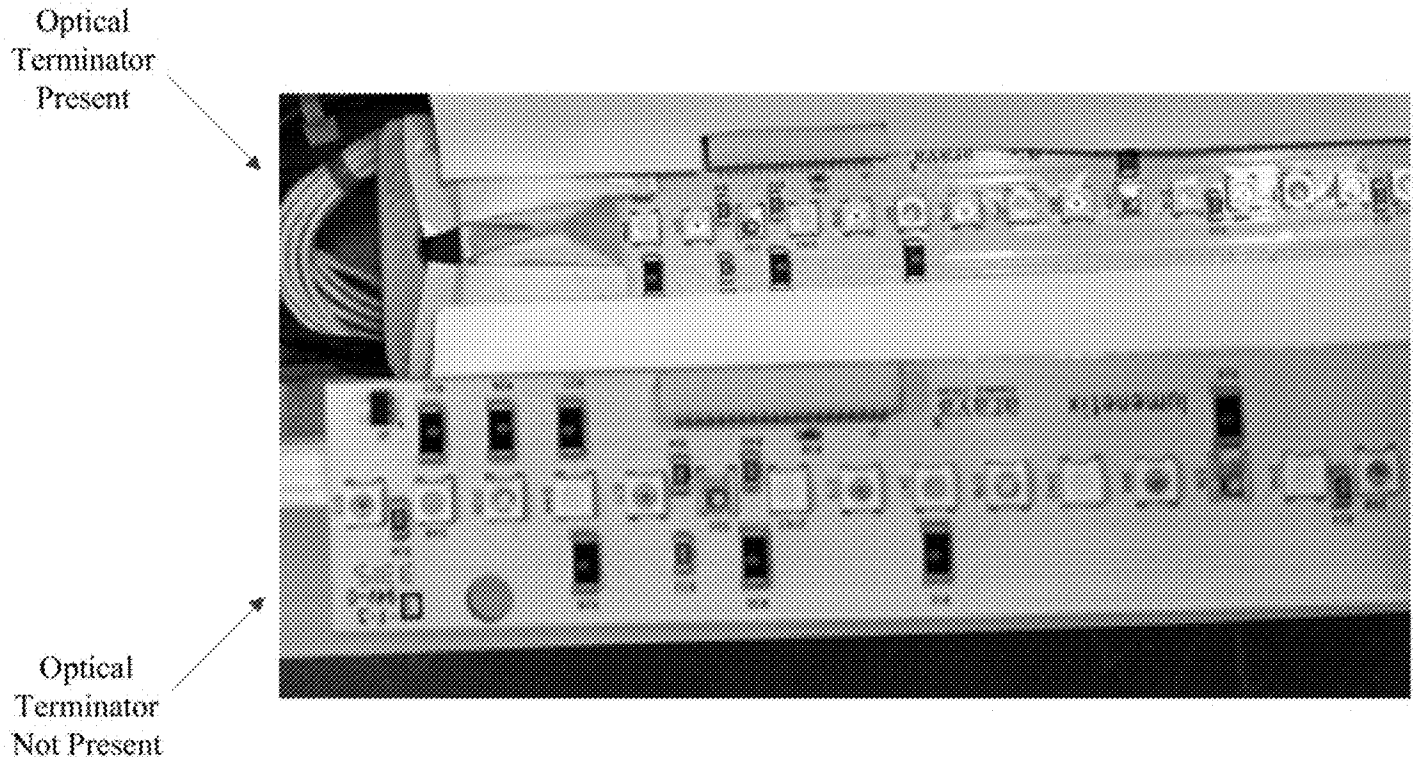
Figure 4E:
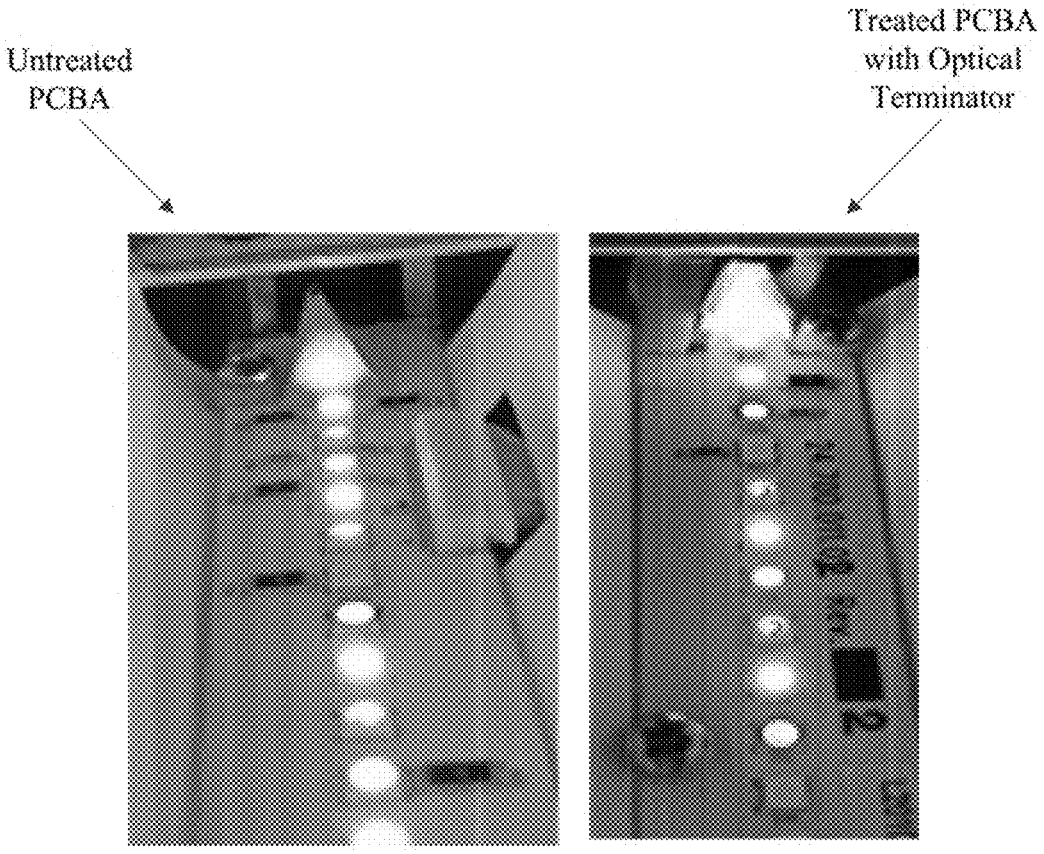

The optical hood preferably minimizes the direct sight of one or more of the outermost LEDs, as shown in FIG. 4D. However, simply covering the LED(s) generally is insufficient. By installing an optical terminator, the light output by the outermost LED(s) is redirected axially back toward the array. In some embodiments, an angled opening (as shown in FIGS. 4A-C) is covered with a diffuser that allows diffused mixed light to pass through. The diffuser could be, for example, a sheet of silicon.

Note also that the optical terminator can, and often does, cover multiple LEDs. For example, an optical terminator at one end of a PCBA may cover two LEDs, while another optical terminator at the opposite end may cover three LEDs. The number of LEDs covered by the optical terminator depends on the pattern formed by the outermost LEDs. More specifically, the number of covered LED(s) depends on the particular arrangement of color LEDs on the PCBA. For example, an optical terminator may only cover two LEDs if those two colors (e.g., red and green) generally mix together well. As another example, an optical terminator may cover three LEDs if those three colors (e.g., red, blue, amber) generally mix together well.

Computer System

Figure 5:
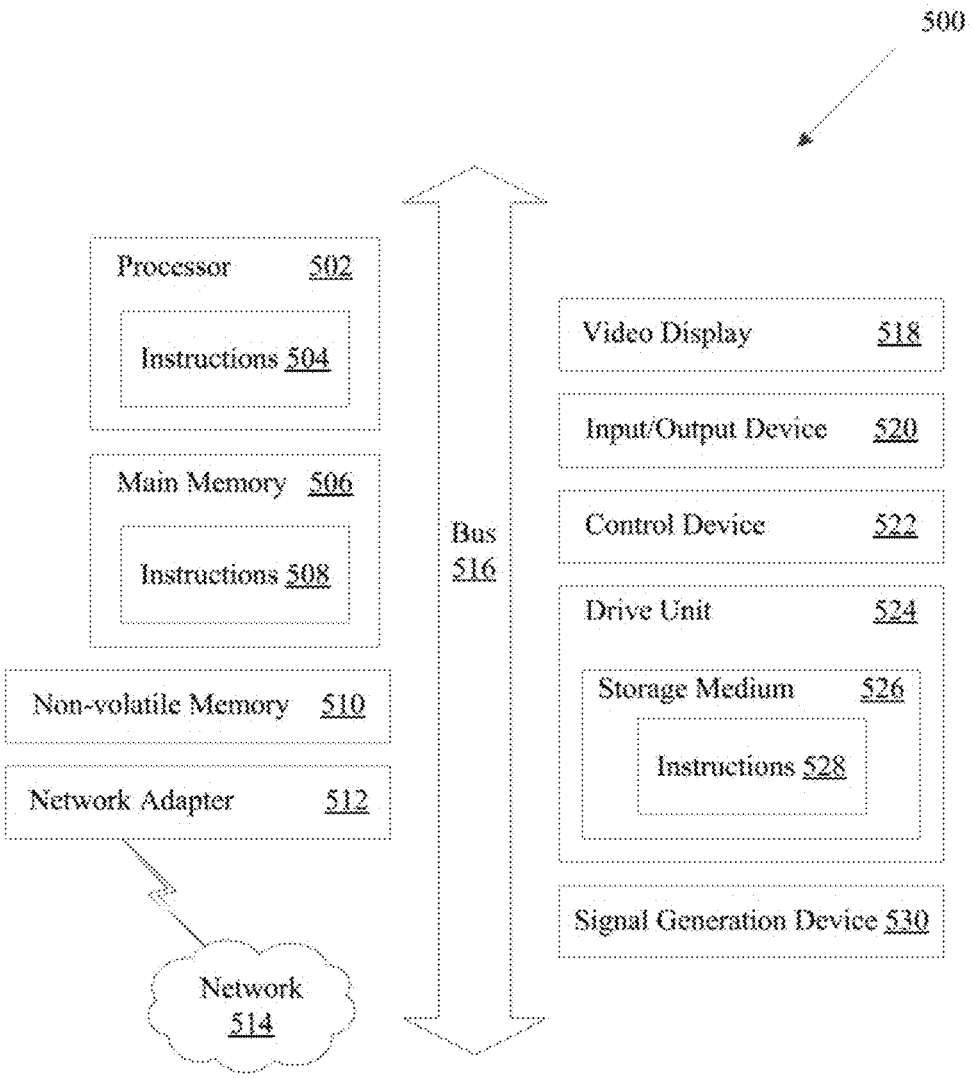
FIG. 5 is a block diagram illustrating an example of a computer system in which at least some operations described herein can be implemented.

FIG. 5 is a block diagram illustrating an example of a computing system 500 in which at least some operations described herein can be implemented. The computing system may include one or more central processing units ("processors") 502, main memory 506, non-volatile memory 510, network adapter 512 (e.g., network interfaces), video display 518, input/output devices 520, control device 522 (e.g., keyboard and pointing devices), drive unit 524 including a storage medium 526, and signal generation device 530 that are communicatively connected to a bus 516. The bus 516 is illustrated as an abstraction that represents any one or more separate physical buses, point to point connections, or both connected by appropriate bridges, adapters, or controllers. The bus 516, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the computing system 500 operates as a standalone device, although the computing system 500 may be connected (e.g., wired or wirelessly) to other machines. In a networked deployment, the computing system 500 may operate in the capacity of a server or a client machine in a client-server network environment, or as a peer machine in a peer-to-peer (or distributed) network environment.

The computing system 500 may be a server computer, a client computer, a personal computer (PC), a user device, a tablet PC, a laptop computer, a personal digital assistant (PDA), a cellular telephone, an iPhone, an iPad, a Blackberry, a processor, a telephone, a web appliance, a network router, switch or bridge, a console, a hand-held console, a (hand-held) gaming device, a music player, any portable, mobile, hand-held device, or any machine capable of executing a set of instructions (sequential or otherwise) that specify actions to be taken by the computing system.

While the main memory 506, non-volatile memory 510, and storage medium 526 (also called a "machine-readable medium") are shown to be a single medium, the term "machine-readable medium" and "storage medium" should be taken to include a single medium or multiple media (e.g., a centralized or distributed database, and/or associated caches and servers) that store one or more sets of instructions 528. The term "machine-readable medium" and "storage medium" shall also be taken to include any medium that is capable of storing, encoding, or carrying a set of instructions for execution by the computing system and that cause the computing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 504, 508, 528) set at various times in various memory and storage devices in a computer, and that, when read and executed by one or more processing units or processors 502, cause the computing system 500 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices 510, floppy and other removable disks, hard disk drives, optical disks (e.g., Compact Disk Read-Only Memory (CD ROMS), Digital Versatile Disks, (DVDs)), and transmission type media such as digital and analog communication links.

The network adapter 512 enables the computing system 1000 to mediate data in a network 514 with an entity that is external to the computing device 500, through any known and/or convenient communications protocol supported by the computing system 500 and the external entity. The network adapter 512 can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 512 can include a firewall which can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

Other network security functions can be performed or included in the functions of the firewall, can include, but are not limited to, intrusion-prevention, intrusion detection, next-generation firewall, personal firewall, etc.

As indicated above, the techniques introduced here implemented by, for example, programmable circuitry (e.g., one or more microprocessors), programmed with software and/or firmware, entirely in special-purpose hardwired (i.e., non-programmable) circuitry, or in a combination or such forms. Special-purpose circuitry can be in the form of, for example, one or more application-specific integrated circuits (ASICs), programmable logic devices (PLDs), field-programmable gate arrays (FPGAs), etc.

Lighting System Topology

Figure 6A:
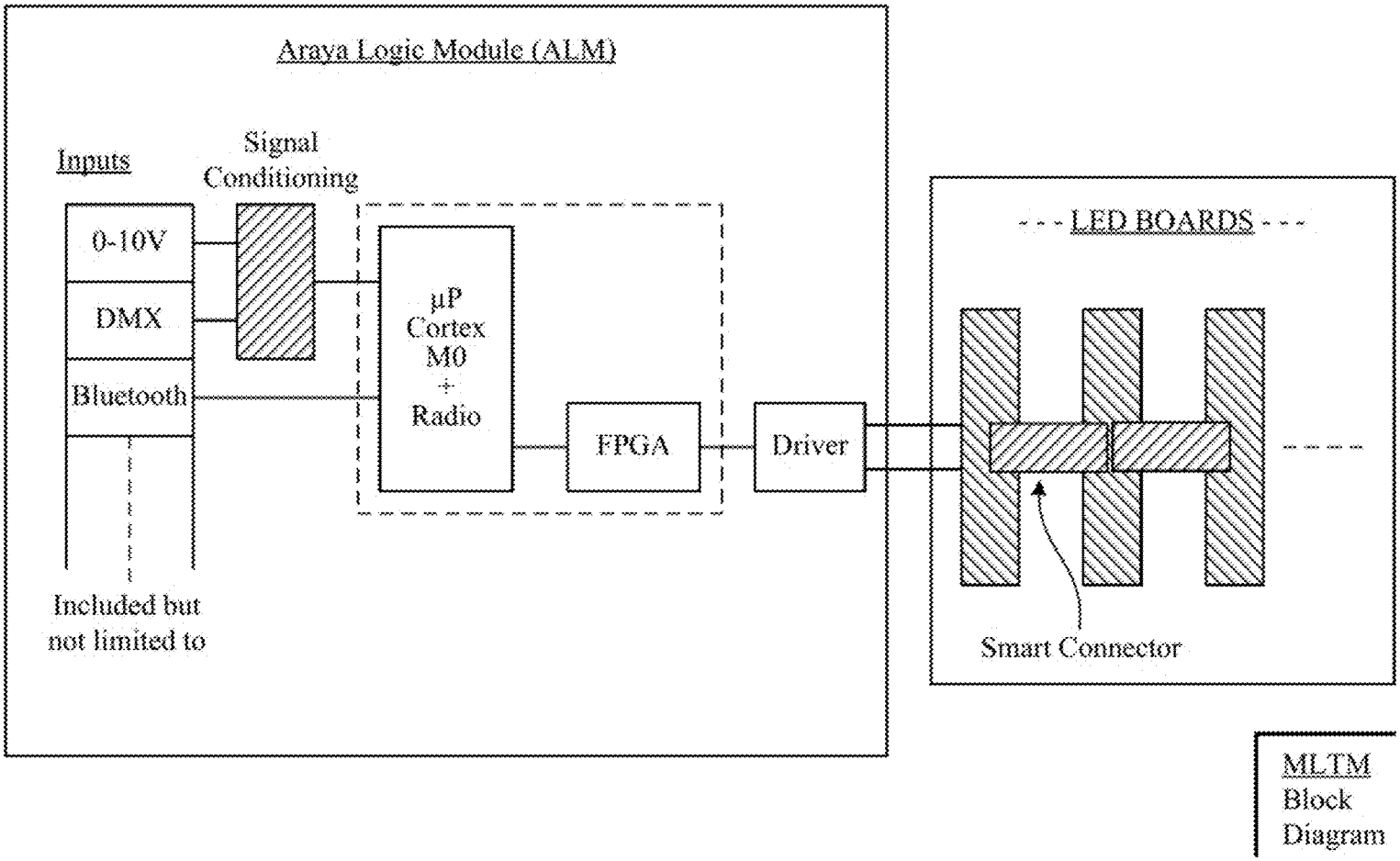
FIGS. 6A-B are high-level block diagrams of an LED-based lighting system that includes a logic module connected to one or more LED boards.
Figure 6B:
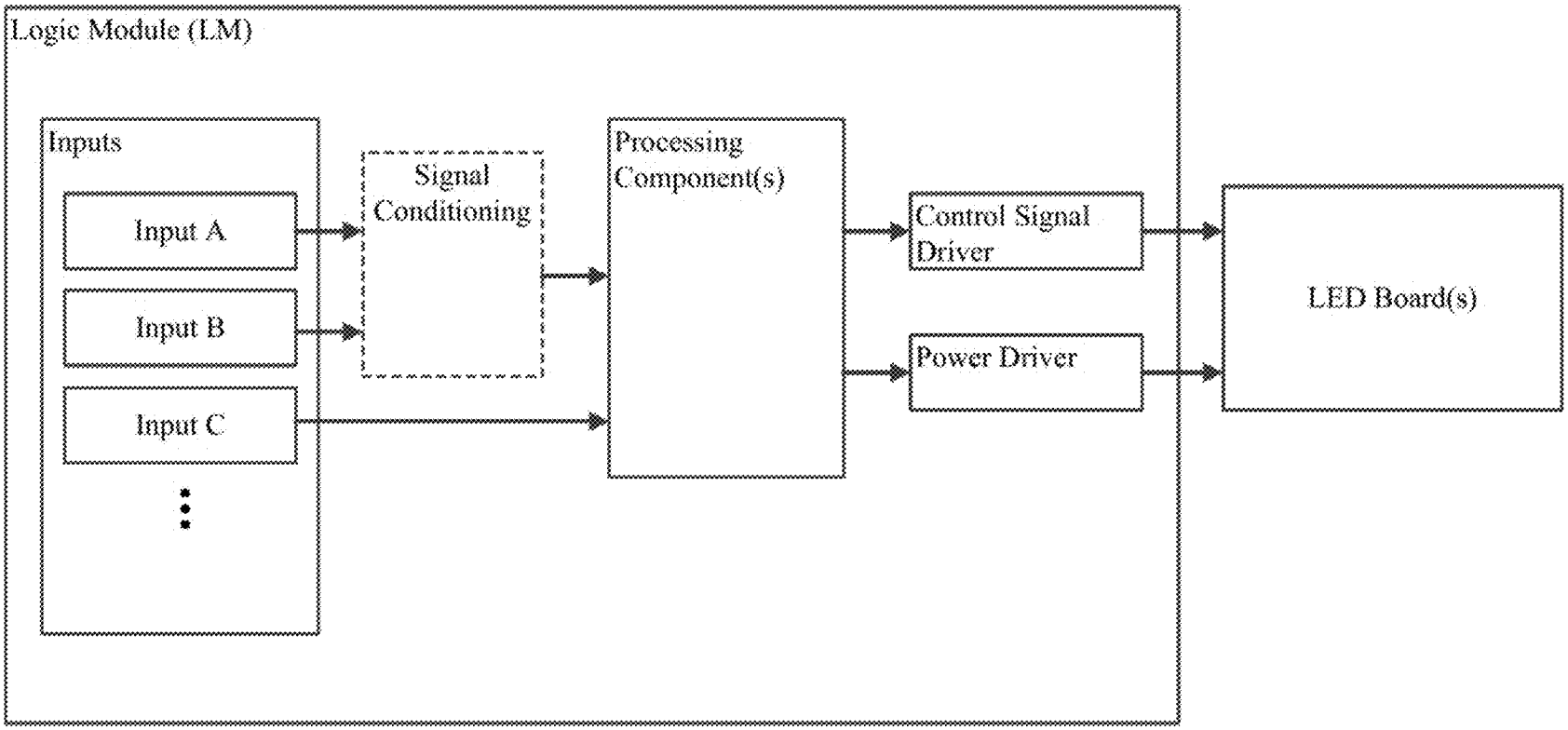
Figure 7:
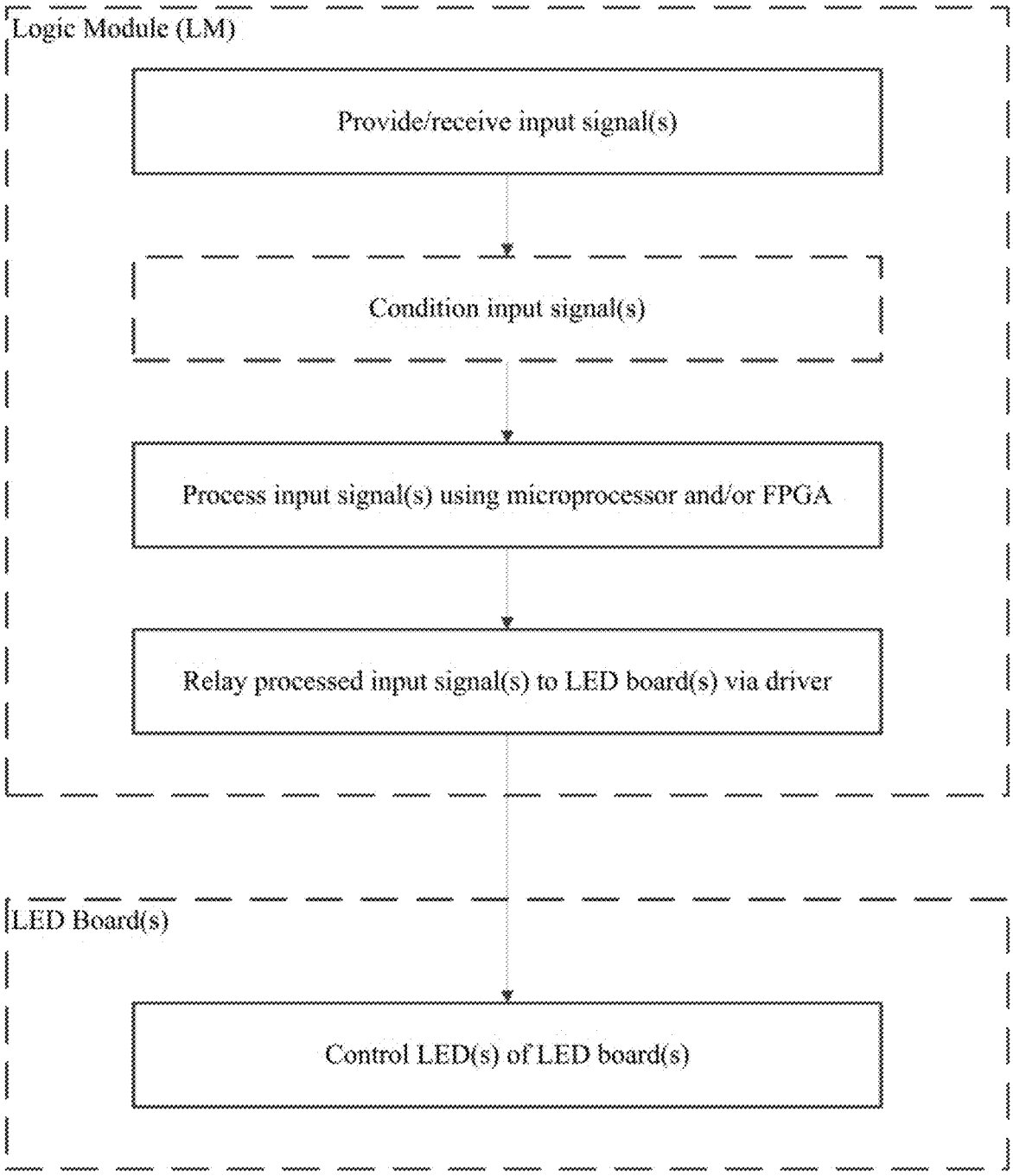
FIG. 7 depicts a process for controllably tuning one or more LED boards using a logic module.

FIGS. 6A-B are high-level block diagrams of an LED-based lighting system that includes a logic module connected to one or more LED boards, while FIG. 7 depicts a process for controllably tuning one or more LED boards using a logic module.

One or more input signals (e.g., input voltage, DMX, Bluetooth®) are received by the logic module and relayed to one or more processing components. The processing component(s) can include, for example, a microprocessor and FPGA. In some embodiments, some or all of the input signal(s) are conditioned (e.g., by a signal conditioning module) before being provided to the processing component (s). The input signal(s) prompt the logic module to control one or more LED boards in a certain manner. For example, the processing component(s) may selectively control a control signal driver, a power driver, or both, which interface with the LED board(s).

In some embodiments, the logic module selectively controls a primary LED board (e.g., using the control signal driver and/or power driver) that is coupled to a secondary LED board. For example, the primary LED board could be coupled to the secondary LED board by a smart connector that causes the driver signals provided to the primary LED board by the logic module to also be provided to the secondary LED board. Similarly, the secondary LED board may be coupled to additional secondary LED board(s) that act in unison with the primary LED board.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

What is claimed is:

1. A method of patterning a linear layout of color light-emitting diodes (LEDs) on a circuit board, the color LEDs being color mixed to produce a light, the method comprising:

determining flux ratios of color channels for color mixing to produce the light, wherein the flux ratios are determined to achieve a power efficacy within a threshold and one or more constraints;

generating a light-emitting diode (LED) distribution density for each one of the color channels based on the flux ratios of the color channels, the LED distribution density corresponding to positional density of the color LEDs of each of the color channels on the circuit board;

generating linear patterns of LEDs for the color channels on the circuit board by generating a linear pattern of LEDs at the LED distribution density for each one of the color channels; and interweaving the linear patterns of LEDs for the color channels, on the circuit board, into a single line by overlapping and shifting the linear patterns of LEDs to generate the linear layout of the LEDs on the circuit board having multiple color channels.

2. The method of claim 1, further comprising:

determining a maximum flux ratio for each one of the color channels according to the flux ratios; and determining a unit distance for consistent color mixing of the LEDs.

3. The method of claim 2, wherein the generating the LED distribution density comprises:

generating a LED distribution density as a minimal density for each one of the color channels based on the maximum flux ratio and the unit distance.

4. The method of claim 1, further comprising:

discretizing positions of LEDs to prevent overlap of circuit elements of the LEDs.

5. The method of claim 1, further comprising:

discretizing positions of LEDs to enforce an equal distance interval between the LEDs.

6. The method of claim 1, wherein the generating the linear pattern of LEDs comprises:

generating a linear pattern of LEDs at the LED distribution density as a preferred pattern for each color channel, wherein the preferred pattern minimizes a number of unnecessary and underutilized LEDs.

7. The method of claim 1, wherein the constraints include a desired color spectrum, a desired brightness level, or a desired level of power usage.

8. A device for determining a linear layout of color light-emitting diodes (LEDs) on a circuit board, the color LEDs being color mixed to produce a light, the device comprising:

means for computing flux ratios of color channels for color mixing to produce the light, wherein the computed flux ratios are determined to be within a threshold power efficacy and one or more color quality threshold metrics;

means for determining a maximum flux ratio for each one of the color channels according to the computed flux ratios;

means for determining a minimal density of each one of the color channels according to the maximum flux ratio and a unit distance on the circuit board to produce a linear pattern of LEDs on the circuit board at the minimal density for each one of the color channels, the minimal density of each one of the color channels corresponding to a minimal positional density of the color LEDs of each of the color channels on the circuit board; and means for overlaying the linear pattern of each one of the color channels, on the circuit board, into a single line by overlapping and shifting the linear pattern of each one of the color channels to produce the linear layout of the LEDs on the circuit board having multiple color channels.

9. The device of claim 8, wherein the light has a desired color rendering index (CRI) or a desired correlated color temperature (CCT).

10. The device of claim 8, wherein the linear pattern of LEDs for each one of the color channels does not repeat continuously.

11. The device of claim 8, wherein LEDs of each one of the color channels are arranged at different frequencies.

* * * * *